US005776542A

United States Patent [19]

Campana

[11] Patent Number: 5,776,542

[45] Date of Patent: Jul. 7, 1998

[54] METHOD OF COATING AN IRON-BASED STRUCTURE AND ARTICLE PRODUCED THEREBY

[75] Inventor: Patsie C. Campana, deceased, late of Lorain, Ohio, Dolores Jenee Campana, executrix

[73] Assignee: P.C. Campana, Inc., Lorain, Ohio

[21] Appl. No.: 418,178

[22] Filed: Apr. 6, 1995

Related U.S. Application Data

[63] Continuation-in-part of Ser. No. 312,661, Sep. 27, 1997, abandoned, which is a continuation of Ser. No. 79,154, Jun. 17, 1993, abandoned.

[51] Int. Cl.[6] ..... C23C 16/00

[52] U.S. Cl. ..... 427/250; 427/374.1; 427/376.3; 427/376.5; 427/376.6; 427/383.5; 427/383.7

[58] Field of Search ..... 427/250, 374.1, 427/376.3, 376.5, 376.6, 383.5, 383.7

[56] References Cited

U.S. PATENT DOCUMENTS

| | | | |
|---|---|---|---|
| 2,857,292 | 10/1958 | Moore | 427/376.3 |
| 3,989,863 | 11/1976 | Jackson et al. | 427/191 |
| 4,117,868 | 10/1978 | Pignollo et al. | 138/146 |
| 4,276,331 | 6/1981 | Bothwell | 428/36 |
| 5,015,507 | 5/1991 | Deslouriers et al. | 427/385.5 |
| 5,067,990 | 11/1991 | Ribitch | 428/36 |
| 5,295,669 | 3/1994 | Companc | 266/265 |
| 5,486,382 | 1/1996 | Ference et al. | 427/376.3 |

*Primary Examiner*—Benjamin Utech

*Attorney, Agent, or Firm*—Fay, Sharpe, Beall, Fagan, Minnich & Mckee

[57] ABSTRACT

The invention relates to a method for forming a corrosion-resistant coating on a ferrous substrate comprising: mixing the coating components in the powdered form with water until all of the powder is in suspension; coating the selected exposed surfaces of the ferrous substrate with the suspension; drying the ferrous substrate coated with the suspension to remove substantially all of the water; heating the coated substrate to an appropriate temperature and maintaining the coated substrate at this temperature for an amount of time sufficient for the formation of an alloy coating at the substrate-coating interface; cooling the coated substrate; and further to the coating produced according to this method.

8 Claims, No Drawings

METHOD OF COATING AN IRON-BASED STRUCTURE AND ARTICLE PRODUCED THEREBY

This application is a continuation-in-part application of U.S. Ser. No. 08/312,611, filed Sep. 27, 1994, now abandoned, which was a continuation application of U.S. Ser. No. 08/079,154, filed Jun. 17, 1993, now abandoned.

BACKGROUND OF THE INVENTION

Iron-containing structures, such as piping, couplings, and the like are widely used throughout the construction and transportation industries because of the mechanical strength and physical characteristics attributed to such materials. An iron-based alloy may be inherently strong, yet lightweight enough to provide construction and operational advantages over other materials.

A constant problem encountered in using iron-based alloys or materials, however, is the tendency of the material to corrode or lose mechanical and structural integrity as a result of contact with certain environmental conditions. Exposure to moisture, whether liquid or gaseous, can cause extensive corrosion damage. Salt attack and acid attack are also common contributors to the corrosion or degradation of ferrous alloys.

These problems are even greater during fabrication of the substrate in preparation for its intended use. While various precoating methods have been developed to overcome these problems with corrosion and degradation, most precoats currently used do not maintain integrity through the fabrication process, but rather tend to crack, wear, or flake, leaving edges and angles exposed and unprotected against attack by corrosive agents.

The subject invention is intended to provide a corrosion-resistant metallic coating for ferrous substrates or articles. The subject coating can be applied prior to fabrication, bending, welding, rolling, or other processing and remains intact through processing to protect the substrate. In addition, the coating of the present invention can be applied to partially or completely preformed structures. Further, a finish coat applied over the subject precoat generally remains undisturbed even through welding of the substrate.

SUMMARY OF THE INVENTION

The invention relates to a method for forming a corrosion-resistant alloy coating on a ferrous substrate comprising: mixing precursor ceramic and metallic coating components in the powdered form with water to form a slurry with substantially all powder in suspension; coating the ferrous substrate with the slurry; drying the coated ferrous substrate to remove substantially all of the water; heating the coated substrate to an appropriate temperature and maintaining the coated substrate at this temperature for an amount of time sufficient for the metallic coating component to alloy with the substrate surface; cooling the coated substrate; and further to the coating produced according to this method.

DETAILED DESCRIPTION OF THE PREFERRED EMBODIMENT

The subject invention relates to a method for depositing a metallic coating on iron-based or ferrous structures or substrates to inhibit corrosion or degradation thereof. Such corrosion or substrate degradation is caused by contact with corrosive agents in the environment or by oxidation of he substrate caused by use of the material under harsh operating conditions, or continuous or repeated contact with corrosive agents such as salt, acids, and other harsh chemicals.

The substrate over which the subject coating is intended to be applied may be any iron-based alloy, such as steel, including carbon steel, flat roll steel, hot roll reinforcing bar (rebar) steel, steel tubing and cast steel, or cast iron. The shape and size of the substrate is not critical to the subject invention. Some examples of the type of ferrous substrate which can be coated include pipe, pipe nipples, threaded adapters, insert hose couplings, cast pillow blocks, threaded unions, forged tees, forged elbows, sprockets, and other similar items. The terms "iron-based" and "ferrous" are used interchangeably herein to identify the substrate material.

Application of the subject corrosion-resistant coating to a ferrous substrate affords the user the capability of applying a protective coating to the substrate material prior to fabrication of the substrate or otherwise working the substrate, in preparation for use. This corrosion resistant coating is unique among precoats in that rolling, flattening, welding or bending the substrate subsequent to application of the coating in no way disturbs the coating. Thus, the substrate remains protected against potentially degrading or corrosive agents to which it is exposed not only during subsequent use, but also during fabrication or working the substrate in any manner specified hereinabove in preparation for subsequent use. Use of the subject coating on ferrous substrates, therefore, totally eliminates the opportunity for degradation or corrosion of the substrate. Further, the coated substrate readily accepts and retains a finish coat.

Hereafter, the corrosion-resistant coating will be discussed in terms of the precursor coating mixture, which comprises a precursor ceramic powder combined with a precursor metallic powder, and the corrosion resistant coating which forms after applying the precursor coating powder mixture to a ferrous substrate and processing the same at elevated temperatures The exact amount of each constituent of the precursor coating mixture may be varied to obtain a coating which will readily alloy with the ferrous substrate surface, under the disclosed process conditions, to form a corrosion-resistant coating at the substrate-coating interface. The composition of the precursor coating mixture applied to the substrate must be such that the high temperature needed to alloy the substrate and the precursor coating composition to create the subject corrosion-resistant coating will not be detrimental to the coating. A further consideration in choosing the exact precursor coating composition is whether a finish coat will be applied over the corrosion-resistant coating, i.e. the two must be compatible. One further consideration in selecting the elemental components of the precursor coating revolves around the capabilities or properties the coating is intended to impart to the final structure.

The precursor coating mixture contains from about 50% to about 70% by weight of a precursor ceramic powder and a balance of a precursor metallic powder, or about 30% to about 50% by weight precursor metallic powder. The elemental composition of the preferred precursor ceramic powder is:

TABLE 1

| CERAMIC ELEMENTAL COMPONENT | % BY WEIGHT OF CERAMIC POWDER |
|---|---|
| Silicon as $SiO_2$ | 38.4 |
| Sodium as $Na_2O$ | 5.4 |
| Calcium as CaO | 2.4 |

TABLE 1-continued

| CERAMIC ELEMENTAL COMPONENT | % BY WEIGHT OF CERAMIC POWDER |
|---|---|
| Barium as BaO | 4.1 |
| Aluminum as $Al_2O_3$ | 22.9 |
| Boron as $B_2O_3$ | 14.3 |
| Magnesium as MgO | 0.5 |
| Potassium as $K_2O$ | 0.1 |
| Titanium as $TiO_2$ | 2.2 |
| Iron as $Fe_2O_3$ | 0.3 |
| Calcined Alumina as $Al_2O_3$ | 9.2 |
| Borax as $Na_2O.2B_2O_3.10H_2O$ | 0.2 |

While the composition of the precursor metallic powder component of the precursor coating mixture will vary depending on the desired characteristics of the final metallic corrosion-resistant coating, examples of suitable elemental components and their ranges of composition are listed below. Zinc and nickel are critical to the metallic component, and should therefore, be employed in the recited ranges.

TABLE 2

| METALLIC ELEMENTAL COMPONENT | % BY WEIGHT OF CERAMIC POWDER |
|---|---|
| Zinc | 65–85 |
| Nickel | 5–20 |
| Chromium | 0–10 |
| Molybdenum | 0–4 |
| Copper | 0–95 |
| Titanium | 0–5 |
| Cobalt | 0–8 |

The precursor coating mixture, comprising the precursor ceramic powder combined with the precursor metallic powder, is mixed with water in a ratio of 2 parts by weight precursor coating powder mixture to approximately one part by weight water to form a water-based paste or slurry. This slurry is then applied to the ferrous substrate.

Prior to application of the precursor coating mixture paste or slurry, the substrate should be thoroughly cleaned. This may be accomplished by any of a number of methods currently used in the industry, such as by sand or shot blasting, pickling in acid, degreasing, and others. Suitable cleaners for accomplishing the necessary cleaning include such cleaners as CRC Brakleen, a commercial brake cleaning product which is known to remove brake fluid, grease and oil. NaOH may also be used at appropriate temperature and for an appropriate length of time, as known to the skilled artisan. Forgings may be cleaned by shot blasting using glass beads. If any part or substrate to be coated bears a lacquer or other finish, this finish should be removed, as by sand blasting, prior to application of the subject precursor coating slurry.

The precursor coating mixture paste or slurry can be prepared by first grinding the individual precursor coating mixture components to an appropriate size, preferably about 320 mesh. The powdered ceramic and metallic components are then combined and water is added at a ratio of 2 parts powder to 1 part water, by weight, to form a paste or slurry.

The precursor coating composition is then applied to the cleaned substrate by submerging the substrate in a paste or slurry of the coating composition, or by other known coating techniques.

Once the slurried powder precursor coating mixture has been allowed to cover the entire surface of the substrate, or any desired portion thereof, the substrate is dried to remove trace water from the coating, leaving the coating up to about 99.9% water-free. Removal of the water from the coating ensures that the coating will not spall or flake when exposed to excessive temperature changes. This drying cycle may be done over time, as needed depending on the size and configuration of the part, by exposure to ambient temperature between 70° F. and 90° F., or by exposure to heat, not in excess of 200° F., such as by placement under heat lamps or other heat sources.

The dried, coated substrate is next heated in a gas or electric furnace to a temperature between about 1600° F. and 2000° F. While the type of furnace used is not critical, temperature control and uniformity throughout the furnace are important to uniformity of the corrosion-resistant coating. The temperature range in the furnace should not exceed ±25° F.

Because the total thermal treatment cycle time varies with mass, weight, substrate content and coating components, only similar parts or substrates should be fired together.

Once the temperature of the substrate reaches a predetermined temperature, the substrate is maintained at this temperature for from about 6 minutes to about 15 minutes. This thermal treatment alloys the coating composition with the substrate surface. For example, twelve (12) pounds of precursor coating mixture can be mixed with five and one-half (5.5) pounds of water to yield one gallon of wet slurry. The viscosity of a slurry prepared in this proportion is of a consistency such that the slurry is easily applied to most any substrate yet adherent to the substrate surface throughout processing. The slurry may be prepared in batch form, with continuous mixing and/or agitation.

During the thermal treatment cycle, as the temperature reaches approximately 1300° F., the precursor ceramic powder component of the coating composition melts to form a liquid phase which is actually a silica glass scale by-product. This liquid ceramic phase rises to the surface of the coating to act as a flux or barrier layer, preventing oxidation of the to-be-deposited metal alloy and of the ferrous substrate.

The ceramic flux agent included in the precursor coating mixture and subsequent paste or slurry functions to prevent oxidation of the substrate during the coating process. Surface oxide films form readily over substrate surfaces in the presence of moisture at elevated temperatures, this film formation being accelerated at temperatures such as those achieved during the thermal cycle of this coating process. It is the purpose of the flux agent to inhibit oxide film growth. The flux agent must, therefore, flow freely over the substrate coating surface, functioning to dissolve oxide films through chemical and physical activity, and yet not attack the substrate surface nor interfere with the alloy coating formation.

As the temperature of the thermal treatment cycle rises beyond 1300° F., and exceeds the melting point of the lowest melting metallic powder component, a liquid metallic phase is created. When all of the metallic powder elements or components have gone into solution, the liquid metallic phase alloys with the surface of the ferrous substrate, which itself has begun to experience a phase change, i.e. incipient melting or "sweat", due to the elevated processing temperature. This alloying phase of the process takes approximately 6 minutes to 15 minutes depending on the precursor metallic powder composition, which will vary with variations in the desired characteristics or performance standards or requirements of the resulting corrosion-resistant coating. The bulk of this time is expended in heating the substrate to the point of incipient melting or sweating. Once this stage is achieved, the corrosion-resistant coating is formed as the metallic liquid phase coating components alloy with the melting or sweating substrate surface.

As the surface of the substrate begins to melt, or sweat, the metallic liquid phase of the precursor coating mixture alloys with the external surface of the substrate forming an alloy coating layer, which is the subject corrosion-resistant coating. Depending upon the substrate, the temperature at which this occurs is likely to be in excess of 1600° F. and up to about 2000° F. As has been previously stated, substrates of the type herein suggested tend to oxidize at these elevated temperatures. To protect against oxidation, the precursor coating mixture includes a ceramic flux agent which normalizes the coating application, preventing the substrate from oxidizing during the formation of the corrosion-resistant coating.

After the thermal treatment, the now coated ferrous substrate is removed from the furnace and allowed to cool at ambient temperature. The cool down cycle may optionally be accelerated by using a source of forced air, such as fans. As the surface of the coated ferrous substrate reaches approximately 400° F., the ceramic flux layer falls away from the surface. This "flaking process", as it is called, occurs as the result of the difference in coefficient of thermal expansion (CTE) between the glass or ceramic flux material and the underlying coated ferrous substrate, the CTE of the ceramic flux material being less than that of the substrate.

The invention further encompasses the addition of a finish coat to the coated ferrous substrate described hereinabove. The purpose of the finish coat may be decorative or functional, or a combination of both. For instance, where the finish coat is brass or bronze, the coating provides a metallic luster, which may add to the aesthetics of the structure, but also affords an extra barrier against corrosive environmental agents given the highly anti-corrosive nature of these materials.

As was previously stated, the outstanding corrosion and heat resistant capabilities of an article or structure bearing the subject corrosion-resistant coating is a function of the alloy or coating formed at the substrate-coating interface. The alloy or coating is formed at elevated temperatures, normally in excess of about 1600° F., during the thermal cycle of the process. This heat treatment may be performed in a standard induction furnace, or by other conventional means, such as in a gas fired or electric furnace. The corrosion-resistant coating performs well under harsh conditions as is demonstrated by its ability to remain rust free for extended periods of time even when subjected to the salt spray (fog) test, identified in Example 1, common to the automobile industry. Under the known test conditions, an uncoated cast iron substrate will rust within the first 1–8 hours, a galvanized substrate will rust within 24–200 hours, a nickel-coated substrate will rust within about 200 hours, and a chromium-coated substrate may last up to about 150–2000 hours. As Table 3 demonstrates, the subject coating consistently resists corrosion for at least 400–2000 hours. It is known to the skilled artisan that 100 hours exposure under these test conditions approximates 1 year of use of an automobile in an environment consistent with that of Chicago, Ill. Of course, the hours recited above may vary due to substrate thickness.

As a preferred embodiment of the foregoing, the invention will be discussed hereinbelow with respect to the coating of various ferrous substrates intended for use in the exhaust systems of automobiles or other motorized vehicles. This is intended to be exemplary in nature and in no way limitative of the invention, as it will be clear to the skilled artisan that the subject technology is equally applicable to use in any industry where substrates require protection from corrosion or other chemical, elemental, or environmental degradation.

EXAMPLE 1

A coated ferrous substrate according to the subject disclosure was prepared by combining two parts precursor ceramic powder, according to the composition recited above, with one part precursor metallic powder containing 73% zinc, 18% nickel, 3% titanium and 6% cobalt. This powder mixture was combined with one-half part water to form a slurry, and was then applied to C1010 steel flat roll substrate. After drying the substrate at 140° F. to remove all water, the steel substrate was heated to 1750° F. in an electric induction furnace. The total time in the furnace was ten minutes.

The deposited alloy coating penetrated 0.001 inches into the ferrous substrate. The thickness of the coating on the surface of the substrate was 0.002 inches.

This coated steel part was tested for corrosion resistance according to the American Society for Testing and Materials (ASTM) standard method of salt spray (fog) testing, Designation B117-64 from Committee G-1 on Corrosion of Metals. No noticeable oxidation rust occurred before 1200 hours of exposure. Without the corrosion-resistant coating, steel would normally rust under these test conditions in less than 24 hours.

EXAMPLE 2

This Example 2 is an example of the application of multiple coatings, according to the subject disclosure, on a ferrous substrate.

Malleable cast iron is very porous compared to the flat roll steel used in Example 1 above. One part of a precursor metallic powder composed of 83% zinc, 16% nickel and 1% chromium was combined with one part precursor ceramic powder. This mixture was combined with water to form a wet slurry as recited in Example 1, and was then applied to a malleable iron casting. The casting was heated to 1750° F. for a total cycle time of eight minutes. This metallic alloy coating was used as an initial or primer coating. After application of this primer coat, a second coating was applied. The second coating contained two parts precursor ceramic powder, according to this disclosure, and one part precursor metal powder contained 73% zinc, 18% nickel, 3% titanium and 6% cobalt. After mixing the 2 parts powder mixture with 1 part water and applying the same to the coated iron casting, the casting was exposed to a 1750° F. thermal treatment for a total of ten minutes. This coated substrate was subjected to identical salt spray chamber testing as that specified in Example 1. This multiple coated sample lasted a minimum of 800 hours before any visible oxidation or rusting occurred. Again, without the corrosion-resistant coating, the substrate would rust in less than twenty-four hours under the test conditions.

Using the processing recited in the foregoing examples, various substrates were coated and tested. Table 3 reports data on the substrates. The table recites the type of substrate coated, the coating content, given as % by weight ceramic mixture in the total coating and the % by weight of the total composition of the individual metal components used. All samples were subjected to a thermal cycle in an electric furnace at 1750° F. Salt spray performance is reported in hours under test conditions without rust formation or oxidation degradation.

TABLE 3

| SAMPLE | CERAMIC | Zn | Ni | Cr | Mo | Ti | Co | Furnace Time (minutes) | Coating Thickness (minutes) | Salt Spray Performance (hours) |
|---|---|---|---|---|---|---|---|---|---|---|
| Flat Roll | 67 | 22.8 | 5.9 | 0.7 | 0.7 | 1.0 | 1.9 | 20 | 0.003 | 1200 |
| Pipe Hanger | 67 | 26.4 | 5.3 | 0.3 | 0.3 | 0.7 | — | 12 | 0.0015 | 864 |
| Flat Roll | 67 | 23.4 | 6.0 | — | 0.7 | 1.0 | 1.9 | 15 | 0.003 | 1008 |
| Flat Roll | 67 | 24.7 | 5.6 | — | 0.7 | 1.0 | 1.0 | 15 | 0.002 | 600 |

The foregoing data shows quite clearly corrosion resistance of well over 600 hours under harsh conditions. Further, the data demonstrates the use of various coating compositions and coating thicknesses, proving versatility of the coating within the parameters, described to meet the requirements of various substrates and end uses.

The subject corrosion-resistant coating, and the process for depositing the same coating, is advantageous in that they provide an economically efficient means for increasing corrosion resistance and heat resistance of the ferrous substrate. While the invention has been set forth herein in the context of certain examples, these examples are intended to be merely illustrative of the inventive coating and the processing used in applying the same. The invention is, therefore, intended to cover these examples and all variations thereof which are readily apparent to the skilled artisan, and which fall within the parameters of the appended claims.

Having described the invention, the following is claimed:

1. A method of forming a coating on a ferrous substrate comprising:

a) preparing a ceramic powder mixture comprising about 38.4% wt. $SiO_2$, about 5.4% wt. $Na_2O$, about 2.4% wt. CaO, about 4.1% wt. BaO, about 22.9% wt. $Al_2O_3$, about 14.3% wt. $B_2O_3$, about 0.5% wt. MgO, about 0.1% wt. $K_2O$, about 2.2% wt. $TiO_2$, about 0.3% wt. $Fe_2O_3$, about 9.2% wt. calcined $Al_2O_3$, and about 0.2% wt. $Na_2O \bullet 2B_2O_3 \bullet 10H_2O$;

b) preparing a metallic powder mixture comprising zinc and nickel;

c) combining the ceramic powder mixture and the metallic powder mixture to create a coating mixture comprising from about 50% to about 70% by weight of the ceramic powder and from about 30% to about 50% by weight of the metallic powder;

d) combining the coating mixture with water to form a slurry;

e) coating the ferrous substrate with the slurry;

f) drying the coated ferrous substrate to remove substantially all of the water;

g) heating the coated ferrous substrate to an elevated temperature and maintaining the coated ferrous substrate at this temperature for an amount of time sufficient for the ferrous substrate surface to alloy with the metallic components of the slurry at the substrate-coating interface; and, h) cooling the coated ferrous substrate.

2. The method according to claim 1 wherein the coated ferrous substrate is heated in an induction furnace.

3. The method according to claim 1 wherein the coated ferrous substrate is heated to a temperature between about 1600° F. and 2000° F.

4. The method according to claim 1 wherein the ferrous substrate comprises an exhaust pipe for a motorized vehicle.

5. The method according to claim 1 wherein the metallic powder further comprises one or more metals selected from the group consisting of chromium, molybdenum, copper, titanium and cobalt.

6. The method of claim 1 wherein the coating of step h) is about 99% water-free.

7. A method for imparting a coating to a ferrous motorized vehicle exhaust pipe comprising:

mixing ceramic and metallic coating components, which have been ground to about 320 mesh, with water to form a slurry, wherein the ceramic components comprise in weight percent about 38.4% wt. $SiO_2$, about 4.1% wt. BaO, about 5.4% wt. $Na_2O$, about 2.4% wt. CaO, about 14.3% wt. $B_2O_3$, about 0.5% wt. MgO, about 22.9% $Al_2O_3$, about 2.2% wt. $TiO_2$, about 0.3% wt. $Fe_2O_3$, about 0.1% wt of $K_2O$, about 9.2% wt. calcined $Al_2O_3$, and about 0.2% wt. $Na_2O \bullet 2B_2O_3 \bullet 10H_2O$ and wherein the metallic components are zinc and nickel, and wherein the ceramic and metallic components are combined as from about 50% to about 70% by weight of ceramic components and from about 30% to about 50% by weight of metallic components;

coating the exhaust pipe with the slurry such that all exposed surfaces of the exhaust pipe are covered;

drying the coating at about 140° F. until the coating is about 99% water-free;

heating the coated exhaust pipe to a temperature sufficient to cause the ceramic coating components to form a flux coat and the metallic coating components to alloy with the exhaust pipe surface to form a coating; and, cooling the coated exhaust pipe.

8. The method according to claim 7 wherein the metallic coating components comprise, in addition to zinc and nickel, one or more further metals selected from the group consisting of chromium, molybdenum, copper, titanium and cobalt.

* * * * *

UNITED STATES PATENT AND TRADEMARK OFFICE

CERTIFICATE OF CORRECTION

PATENT NO. : 5,776,542
DATED : July 7, 1998
INVENTOR(S) : Patsie C. Campana

It is certified that error appears in the above-indentified patent and that said Letters Patent is hereby corrected as shown below:

Title Page, Section 63, line 1, delete "1997", and insert therefor: ---1994---.

Signed and Sealed this

Nineteenth Day of January, 1999

*Attest:*

*Attesting Officer*

*Acting Commissioner of Patents and Trademarks*